United States Patent [19]

Paton et al.

[11] 3,979,101

[45] Sept. 7, 1976

[54] MOULD FOR CASTING AT LEAST ONE COMPONENT OF COMPLEX-SHAPED METAL ARTICLES

[76] Inventors: Boris Evgenievich Paton, ulitsa Kotsjubinskogo, 9; Boris Izrailevich Medovar, Bulvar Lesi Ukrainki, 2, kv. 8; Georgy Alexandrovich Boiko, ulitsa Vladimiro-Lybedskaya, 16, kv. 106; Ilya Iosifovich Kumysh, Vozdukhoflotsky prospekt, 42, kv. 51; Leonid Gustavovich Puzrin, ulitsa Vladimirskaya, 71, kv. 48; Viktor Alexandrovich Kovalev, ulitsa Ivana Kudri, 23/21, kv. 30; Georgy Sergeevich Marinsky, ulitsa Tatarskaya, 1"b", kv. 19; Alexandr Petrovich Beloglazov, ulitsa Ushinskogo, 5a, all of Kiev; Pavel Osipovich Siry, ulitsa Kotelnaya, 1/15, kv. 285; Alexandr Ivanovich Sopozhnikov, ulitsa Mosfilmovskaya, 17/25, kv. 63, both of Moscow; Valentin Alexandrovich Nosanov, prospekt Bolshevikov, 37/1, kv. 13, Leningrad; Volf Iudovich Babinovich, ulitsa Gagarina, 74, kv. 27, Chekhov; Lev Vasilievich Popov, ulitsa Kharkovskaya, 2, kv. 21, Bryansk; Sergei Mikhailovich Shelkov, ulitsa Bryanskoi proletarskoi divizii, 9, kv. 33, Bryansk; Vladimir Nikolaevich Strukov, ulitsa Kuibysheva, 13, kv. 17, Bryansk; Boris Markovich Babich, ulitsa Bryanskoi proletarskoi divizii, 26, kv. 19, Bryansk, all of U.S.S.R.

[22] Filed: Feb. 7, 1975

[21] Appl. No.: 548,032

Related U.S. Application Data

[60] Division of Ser. No. 432,154, Jan. 10, 1974, Pat. No. 3,894,574, which is a continuation of Ser. No. 323,379, Jan. 15, 1973, abandoned, which is a continuation of Ser. No. 120,141, March 2, 1971, abandoned.

[52] U.S. Cl. ..... 249/97; 164/252; 164/333

[51] Int. Cl.[2] ..... B22D 19/04; B22D 27/02

[58] Field of Search ..... 164/52, 98, 105, 108, 164/110, 112, 252, 332, 333; 219/73 R, 73 A; 249/97

[56] References Cited

UNITED STATES PATENTS

| | | | |
|---|---|---|---|
| 2,957,214 | 10/1960 | Kuharski | 249/97 X |
| 3,291,955 | 12/1966 | Shrubsall et al. | 219/73 A |

*Primary Examiner*—Francis S. Husar
*Assistant Examiner*—John E. Roethel
*Attorney, Agent, or Firm*—Holman & Stern

[57] ABSTRACT

A mould for casting at least one component of a complex-shaped metal article, the mould having in the fusion area at least one hole hole fitted from the mould interior with a slot whose geometric dimensions ensure the formation of a slag blanket in the volume which is required for a uniform heat removal in the fusion area. The number of the holes correspond to the number of the article components to be joined by fusion and the geometric dimensions and contour of the holes matching those of the article components to be bonded by the application of a fusion process.

1 Claim, 8 Drawing Figures

MOULD FOR CASTING AT LEAST ONE COMPONENT OF COMPLEX-SHAPED METAL ARTICLES

This application is a Divisional of Ser. No. 432,154, filed Jan. 10, 1974 now U.S. Pat. No. 3,894,574, which, in turn, was a Rule 60 Continuation of Ser. No. 323,379, filed Jan. 15, 1973, now abandoned, which, in turn, was a Rule 60 Continuation of Ser. No. 120,141, filed Mar. 2, 1971, now abandoned.

BACKGROUND OF THE INVENTION

The present invention relates to the procedures for manufacturing metal articles of intricate profile by permanent connection of their components which may be effected by various methods, such as: welding, shrink-fit, etc., and to moulds for casting at least one of the components of such articles.

The present invention can find application in the production of, e.g., fitting valve bodies for power plants of steam power stations, crankshafts and connecting rods for high-duty diesel engines, propellers, pressure vessels with pipe-branches, heavy pieces of variable cross section, made conventionally from forged blanks, etc.

Known in the art is a method for manufacturing complex-shaped articles by welding together separate components. For example, vessel casings may be made from individual prefabricated parts encluding shells, bottoms and connecting pieces; gas or steam turbine rotors may be made from separate shafts, disks, rings, etc.

Also known is a procedure for the fabrication of heavy size crankshafts by joining together crankwebs and pins, which have been produced separately. Steel crankwebs are sand-cast, while crankpins are manufactured by forging ingots. After appropriate mechanical working, the webs are fitted with holes and the crankpins turned, whereupon they are shrink-fitted to obtain a crankshaft. The above technique is being used by the Danish company, Burmeister and Wain in producing crankshafts for ship diesel engines.

Well known are moulds for casting various articles or their components by electroslag remelting of, say, a consumable electrode (see, for example, G. Bhat, "Current Progress with Electroslag Remelting -Scientific Problems of Welding and Special Electrical Metallurgy, Pt 4" Naukova Dumka, Kiev, 1970).

However, the known process is disadvantageous in that the production of welded construction in general, and vessel casings, gas and steam turbine rotors, etc., in particular, is a very labor-consuming operation and, first and foremost, an operation which involves a large volume of erection welding. The process of welding wide pre-fabricated parts of, e.g., alloyed steels, becomes a problem, since it requires preheating prior to welding. At the present time some high-tensile steel grades do not lend themselves to welding at all.

The known method of manufacturing crankshafts by joining together the crankwebs and pins with the use of a shrink-fit is not free of serious shortcomings and disadvantages either.

Firstly, in sand-casting of crankwebs a large percentage of rejects may occur. In the second place, as-cast metal features rather inferior mechanical properties, especially in terms of its ductility. Thirdly, inherent in the foregoing technique, according to which crankwebs and pins are shrink-fitted to join them together, is a very low metal use factor. This is attributed to the fact that with a single view to providing a reliable connection between the crankweb and the crankpin, it is necessary to have around the fit holes in the crankweb a considerable amount of metal, which actually does not take part in the web operation.

Attempts to produce crankshafts by coupling separate pre-cast or pre-forged cranks have also proved rather inadequate, since in either case they call for a substantial increase in both labor requirements and the initial cost of the crankshafts.

SUMMARY OF THE INVENTION

It is an object of the present invention to eliminate the above disadvantages.

The present invention is in essence aimed at developing a method for fabricating complex-shaped metallic articles and a mould for casting at least one of the components of such articles which enables a substantially simplified technology of production along with a greatly improved quality of the articles.

The object is achieved by using a method for the production of metal articles of intricate profile with the aid of a permanent connection, in which the components of a future article are joined together, in conformity with the invention, by fusion. To do this, the components to be fused are so arranged with respect to a mould that the sections to be fused face the mould working chamber, whereas the other component of the article is manufactured in the above mould by remelting a metal blank, partially submerged in the slag bath which is formed in the mould and adequately heated by the electric current, flowing through it, to melt the blank and to fuse the aforesaid components of the article to the piece being cast in the mould.

As soon as the slag bath reaches the section of one of the components subject to bonding by the application of a fusion process, it is expedient to lower the line voltage passed through the molten slag below the rated operating voltage value.

According to the present invention, as the slag bath comes up to the section to be fused on one of the article components to be joined by fusion, power circuit is used which includes the blank being remelted, the slag bath and the component to be fused.

Where hollow components are to be joined by fusion to the piece being cast, a filler may be introduced into the interior of such components prior to fusion.

The aforesaid object is also achieved by using the mould for casting one of the components which, in conformity to the proposed method, is fitted with a hole located in the future fusion area of the component to be coupled by fusion to that being cast in the mould, with the geometric dimensions and shape of the above hole mating that of the article section to be joined by fusion, the hole being expanded from the mould interior to provide the formation of the slag skin in the volume needed for a uniform heat removal from the fusion area.

BRIEF DESCRIPTION OF THE DRAWINGS

Further on, the present invention is illustrated by exemplary embodiments, to be considered with reference to the accompanying drawings, wherein.

DETAILED DESCRIPTION OF THE PREFERRED EMBODIMENT

To make the proposed procedure easier to comprehend, it will be described in connection with specific examples of producing complex-shaped articles, such as the valve body for fittings employed in power plants of steam power stations.

Figure 1:
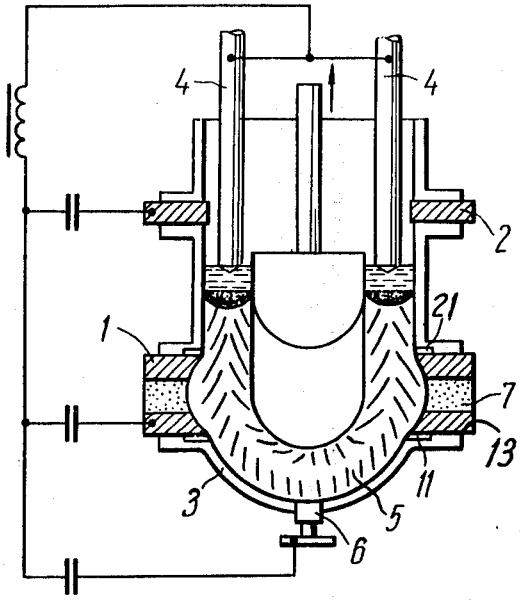
FIG. 1 is a schematic drawing showing the production of a valve body in accordance with the invention.

As shown in FIG. 1, the parts of the article to be joined together by fusion e.i., pipe branches 1 and a flange 2 are set up in a cooled mould 3 at the point where the process of fusion should be effected so that the sections to be fused face the interior of the working chamber of the mould 3. Fusion is carried out directly in the course of remelting a metal blank 4 partially submerged in a slag bath which is formed in the mould 3 and heated adequately by flowing through it an electric current in order to remelt the blank 4 and fuse the pipe branches 1 and the flange 2 with a valve body 5 being cast in the mould 3.

The quality of joints obtained by fusing the pipe branches 1 and the flange 2 substantially depends on the extent to which the sections to be fused are heated prior to fusion. For that purpose, as soon as the slag bath reaches the section to be fused, e.g., the branch 1 the electroslag remelting of the blank 4 can be accomplished at voltage values for the current passing through the slag bath which are lower than the rated operating voltage. The most favorable value by which the voltage can be reduced in the fusion area ranges from 20 to 30 percent of the rated operating voltage.

Figure 2:
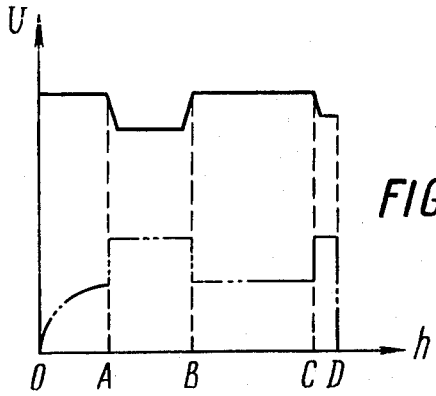
FIG. 2 is a graph displaying variation in the operating voltage while casting the valve body according to the invention.

The curve relating the operating voltage to the casting height during the casting of the body 5 and the coupling to it of the pipe branches 1 and the flange 2 by fusion is shown in FIG. 2. In casting the bottom of the body 5 (section OA) the operating voltage is equal to the rated value. As the fusion of the pipe branches 1 is started, the operating voltage is lowered and remains at that level (section AB) until fusion is accomplished. On completion of the fusion of the pipe branches 1 the voltage is increased to the rated value and maintained at that level during casting the wall of the body 5 (section BC). At the moment when the flange 2 is being joined by fusion the voltage is lowered once more (section CD).

The quality of fused joints produceed when bonding separate components of the article depends also on the current distribution in the article component being cast. The most favorable conditions for the fusion process occur when all the power consumed or at least its major portion passes through the section of the component of the future article to be joined by fusion. Consequently, in casting the body 5 and in connecting the pipe branches 1 and the flange 2 to that body by fusion the circuit which includes the blank 4 and a base plate (starter-bar) 6 is broken, the current being passed instead through a new circuit which incluldes the blank 4, the slag bath, the pipe branches 1 and flange 2).

The pipe branches 1 being hollow, to keep the geometric dimensions of the cavities constant prior to fusion the pipe branches 1, their interiors are primed with a filler 7, which may be, for example, flux employed in casting one of the components of the article through the use of the electroslag remelting process. Graphite or a flux with a higher melting point than the conventional flux employed in casting, may also be used as a filler. In dealing with the interiors of a comparatively simple shape, such as cylindrical holes, a cooled core may replace the filler to preserve the cavities in fusing the pipe branches.

It is quite obvious that the pieces to be fused may have any other, and sometimes a far more complex, profile. However, a similar operational sequence must be used in producing the entire article.

Thus, by using the above technique the housing of a nuclear reactor may be manufactured with all the requisite connections in its flange portion. Also a propeller may be manufactured, in which case it is necessary to secure the blades, to the hub being cast in the mould by a fusion process, the blades having been installed beforehand in a certain position with respect to the mould.

Fabrication of the crankshafts for heavy-duty naval diesel engines may serve as another example illustrating the production of complex - shaped parts by the proposed method.

Figure 3:
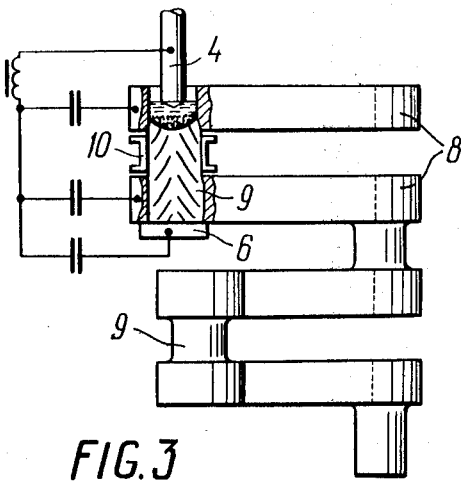
FIG. 3 is a schematic drawing illustrating the production of a crankshaft according to the invention.

Referring to FIG. 3, in the fusion area there are arranged two crankwebs 8 which are bonded to a crankpin 9 by fusion when the pin 9 is cast into the holes provided in the webs 8 and in an intermediate mould 10 by electroslag remelting of either mobile or-fixed blank 4.

In order to provide high-quality fused joints by electroslag remelting in the fusion area where the crankwebs 8 are coupled by fusion to the crankpin 9, the electroslag remelting is effected at a lower voltage, as compared to the rated value, but at an adequate voltage to ensure complete fusion.

In the course of casting the crankpin 9 and bonding the crankwebs 8 to it by fusion, the electric circuit which includes the blank 4 and the base plate 6 is broken and the operating current flows through the circuit which includees the blank 4 and the web 8 (at first one and then the other).

Figure 4:
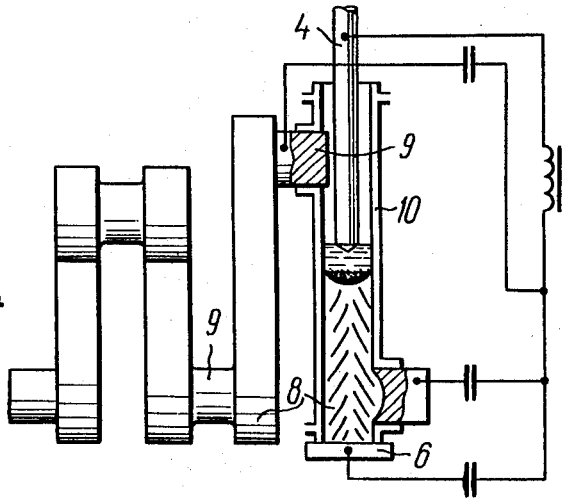
FIG. 4 shows a modified version of a process for fabricating a crankshaft in accordance with the invention.

It is also possible to manufacture a crankshaft by the electroslag remelting of the blank 4 in order to cast the crankwebs 8 in the mould 10 and by coupling by fusion to the webs of the crankpins 9, one after another (FIG. 4).

In this case one may change, as required, the values of the operating voltage in the fusion area where the pins 9 would be coupled by fusion to the web 8 being cast, following which the circuit which includes the blank and the base plate 6 would be broken and the operating current would be passed through a new circuit which includes the blank 4, the slag bath and the pin 9 in fusing it to the crankweb 8 being cast by the electroslag remelting process.

The most simple method that which is most and readily implemented from the technological point of view is the fabrication of crankshafts from separate cranks made by coupling the components of one type (webs or a pin) to the other one (a pin or webs) when the latter are being manufactured by casting.

Figure 5:
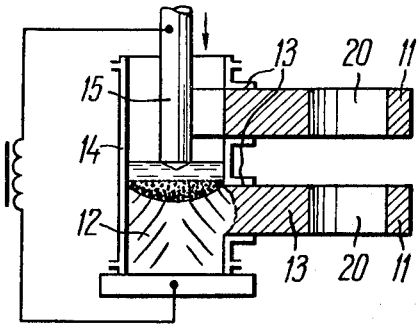
FIG. 5 is a layout depicting a procedure for manufacturing a crankshaft according to the invention.
Figure 7:
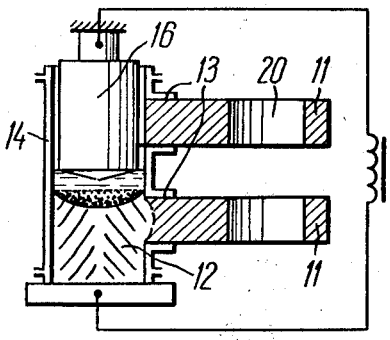
FIG. 7 is another modification of a procedure for manufacturing the crank of a crankshaft in accordance with the invention.
Figure 6:
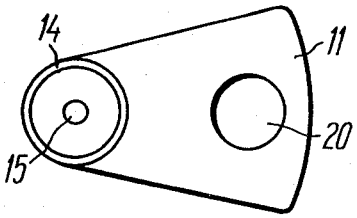
FIG. 6 is a top view of the layout displayed in FIG. 5.

As shown in FIGS. 5 and 6, crankwebs 11 are set up at the point where they should be bonded by fusion to a pin 12, the process being accomplished through holes 13 in a mould 14 designed for casting the pin 12. The latter is cast by the electroslag remelting of either a mobile blank 15 or a fixed blank 16 (FIG. 7). As the crankpin 12 is being cast, the webs 11 are joined to it by fusion, forming the crank of a crankshaft with the web 11 and the pin 12 permanently connected. A crankshaft may be made of the cranks thus produced which are mounted on the journals by using a shrink-fit.

Figure 8:
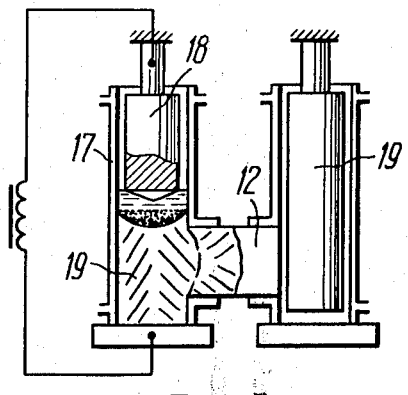
FIG. 8 is another modification for a procedure of manufacturing the crank of a crankshaft in accordance with the invention.

Shown in FIG. 8 is a modified technique for the manufacture of cranks by employing the proposed method. The pin 12 is arranged in a mould 17 wherein webs 19 are being cast either in succession or at one and the same time by electroslag remelting of a fixed blank 18 and the pre-set pin 12 is joined by fusion to the webs.

As shown in FIGS. 5 and 6, the webs 11 of the crank produced in conformity with the first version of the proposed procedure, may be fitted with holes 20 in advance, thus facilitating the machining of the cranks before they are assembled to form a crankshaft.

In the production of crankshafts use may be made, if necessary, of the foregoing technological principles (variations in the operating voltage values, current lead - in etc.).

As exemplary embodiment of the mould for producing the valve bodies for fittings of steam power stations through the use of the above technique is illustrated in FIG. 1. The mould 3 is fitted with the holes 13 situated in the future fusion area where the pipe branches 1 and the flange 2 are to be joined by fusion to the body 5 of the valve. The geometric dimensions and shape of the holes and the branch 1 and flange 2 sections to be fused should match. From the interior of the mould 3 the holes have slot 21 whose geometric dimensions ensure the formation of a slag blanket in the volume needed for a uniform heat removal in the fusion area when casting is proceeding. Increased heat removal at the inner edge of the hole in the mould 3 can give rise to defects in the form of poor fusion on the: branch 1 the body 5 boundary line located on the exterior of the valve body 5.

Thus, for branches of 200 mm outer diameter and walls 50 mm thick, the slot may be from 4 to 5 mm deep and from 20 to 25 mm wide. Depending on the configuration of the article section to be fused (in the fusion area) the slot may have another profile.

Referring to FIG. 5, the mould 14 for casting cranks of crankshafts in accordance with the first version of the procedure proposed for the production of crankshafts may be a hollow cylinder with a lateral surface provided with two holes 13, whose shape and geometric dimensions match those of the web 11 sections to be fused as well as the spacing between the holes 13 and the webs 11.

In each particular case the mould profile may fit the contour of the component to be cast with the holes in the mould housing and the components to be fused spaced apart by the same distance, while the shape and geometrical dimensions of these holes correspond to those of the article components to be joined by the fusion process.

The proposed technique of producing complex-shaped metal articles from separate components affords the possibility of making them truly composite, i.e., the metal of the components to be fused and cast may differ in chemical composition and, accordingly, in strength properties. This in turn, enables manufacture of most heavily loaded pieces of the metal possessing better strength characteristics. For instance, by producing the crankshaft of composite construction, it is possible to decrease its dimensions and, consequently, its weight. The propeller blades, being susceptible to heavy loads, can be made of steel with better wear-resisting properties than the hub.

The use of composite articles is highly expedient in terms of cost reduction, since there is no further need to make them totally from expensive or critical materials.

The proposed technique makes it possible to implement still another method, when the component to be cast may have a different chemical composition over its length, e.g., the working portions of the crankshaft journals and connecting rod bearings may be cast of metal with better strength properties than the as-cast crankweb sections. It is achieved by remelting the blanks made of several parts, each or several of which differ in their properties.

The proposed technique of the production of complex shaped articles represents a fundamentally novel solution in the art. It may be very easily carried into practice, being also dependable and advantageous from the point of view of economics. The foregoing method permits the production of articles ranging in weight from several hundred kilograms, such as valve bodies for fittings employed in steam power stations, to several hundred tons e.g., crankshafts for ship diesel engines.

One of the irrefutable merits of the process of the invention is that it allows both the fabrication of single unique items, such as heavy crankshafts for superpower diesel engines and large-scale production of such pieces as valve bodies for fittings employed in steam power stations, pressure vessel casings, etc., without considerable capital expenditures.

We claim:

1. A mould for casting at least one component of a complex-shaped metal article, the mould comprising: a base plate; a housing mounting the base plate and fitted with at least one hole located in the fusion area of the mould, the number of holes being equal to the number of article components to be bonded by fusion to the at least one component being cast in the mould, and the geometric dimensions and shapes of the holes matching those of the fusion area of the article components to be bonded by fusion; and slots in the holes to provide expension of the holes from the mould interior to ensure the formation of a slag blanket in a volume required for a uniform removal of heat in the fusion area.

* * * * *